United States Patent [19]

Goldner

[11] Patent Number: 4,506,582

[45] Date of Patent: Mar. 26, 1985

[54] SHOULDER SUPPORT FOR VIOLIN OR VIOLA

[75] Inventor: Richard Goldner, Bellingham, Wash.

[73] Assignee: Shar Products Company, Ann Arbor, Mich.

[21] Appl. No.: 615,430

[22] Filed: May 30, 1984

[51] Int. Cl.[3] ..... G10D 3/18; G10G 5/00

[52] U.S. Cl. ..... 84/280

[58] Field of Search ..... 84/274–283

[56] References Cited

U.S. PATENT DOCUMENTS

| | | | |
|---|---|---|---|
| 3,479,916 | 11/1969 | Wolf | 84/280 R |
| 3,690,211 | 9/1972 | Long | 84/280 R |
| 3,896,694 | 7/1975 | Goldner | 84/280 R |

FOREIGN PATENT DOCUMENTS

| | | | |
|---|---|---|---|
| 44737 | 8/1971 | Finland | 84/280 R |

*Primary Examiner*—Lawrence R. Franklin

*Attorney, Agent, or Firm*—Reed Smith Shaw & McClay

[57] ABSTRACT

A shoulder support for use by performers on violin or viola which includes dual chambers secured in accordion-like fashion to provide increased lateral stability and/or increased cushioning capacity. Novel attachment members include slidable resilient elements which function to facilitate adjustment of attachment strap length while providing a surface-protecting support surface for the body of the instrument.

14 Claims, 4 Drawing Figures

SHOULDER SUPPORT FOR VIOLIN OR VIOLA

FIELD OF THE INVENTION

The invention relates to shoulder supports to be used by the violin or viola player, and more particularly to such a shoulder support which is adjustable to accomodate the full range of instrument sizes and player dimensions and preferences.

DISCUSSION OF THE PROBLEM

Devices designed to provide support between a violin or viola and a performer's shoulder have been known and used for many years. Examples of such devices include simple resilient pad arrangements, complicated rigid padded bars mounted to the back of the instrument, and "scaffold like" supporting devices having heavy rubber bands attached thereto.

More recently, as disclosed in U.S. Pat. No. 3,896,694, a more universally useful shoulder support has become available, including a pliable inflatable member having at least two slots therethrough in which is positioned a resilient attachment strap of a fixed length. The resilient attachment strap includes an angular engagement member at each end to secure the pliable inflatable member to the instrument by resilient tension. Although useful to a substantial number of performers, such device has been found to be limited in its capacity to comfortably accomodate the full range of performers because of the considerable differences in the anatomy and idiosyncrasies of the performers interested in using the device. For example, differences in neck length, collarbone and chin size, and instrument size mandate a wide range of adaptability in this type of device, particularly where child performers form a substantial portion of the body of users. The fixed length resilient attachment strap of the subject patent may not provide the needed adaptability. In addition, the "single chamber" inflatable member of the subject patent may not provide sufficient height or thickness for performers with long necks and/or if inflated to sufficient height, it may lose the stability or firmness necessary to minimize wobble of the instrument during vigorous play. It would be useful to have a shoulder support for violin or viola which is universally adaptable to the full range of instrument and performer sizes and styles.

SUMMARY OF THE INVENTION

The present invention introduces a shoulder support for violin or viola which may be used with a wide range of differently dimensioned instruments and performer sizes and preferences. According to the invention, first and second inflatable chambers are secured together in a novel accordion-like fashion to provide sufficient thickness of support for the full range of performers, while retaining the necessary lateral stability when fully inflated to minimize unintended movement of the instrument during vigorous play. The invention also provides novel attachment strap adjusting facilities which permit the shoulder support to be secured to any size of violin or viola without requiring any rigid fastening members which could mar the surface of the instrument and/or generate highly undesirable buzzing sounds during play. To such end, the invention provides a resilient pad member which is slidable on an angular engagement member to engage the instrument with a resilient face while at the same time serving to retain the attachment strap at a desired length.

DESCRIPTION OF PREFERRED EMBODIMENTS

Figure 1:
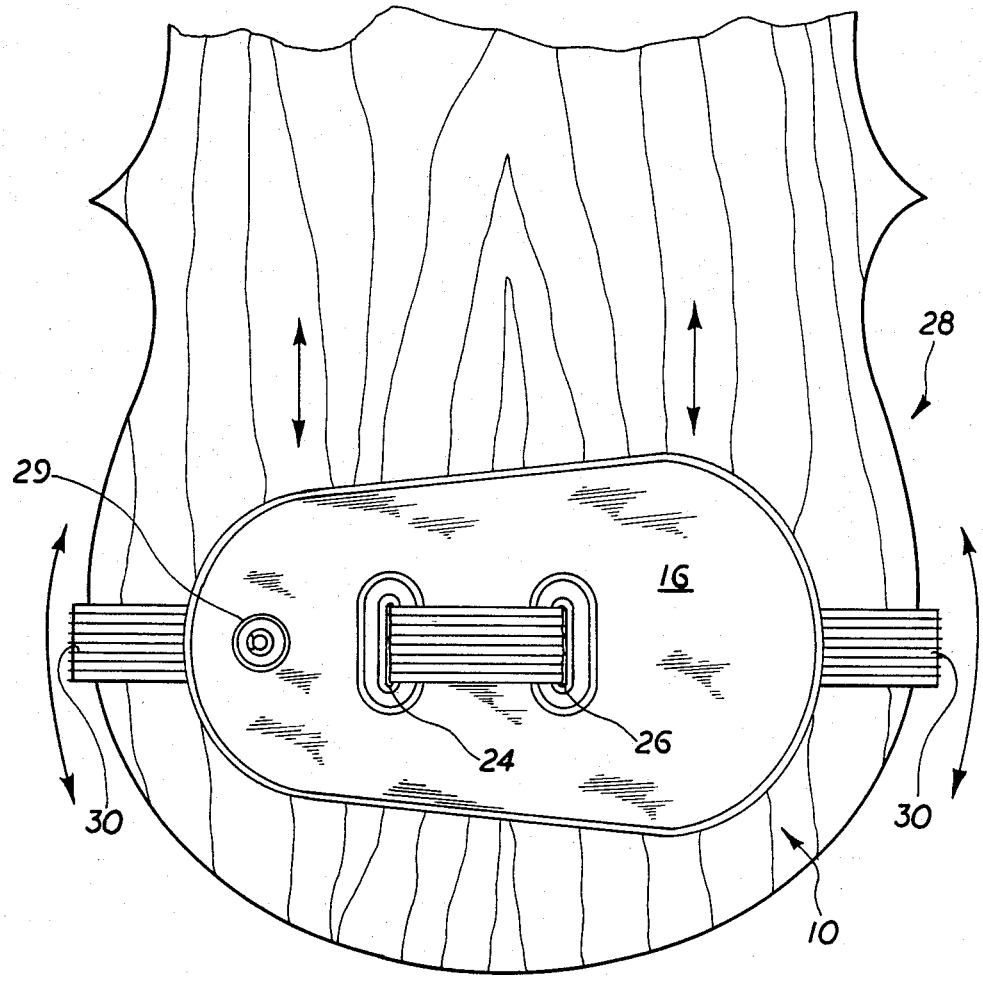
FIG. 1 is a plan view of the improved shoulder support of the present invention secured to the rear of a violin or viola.
Figure 2:
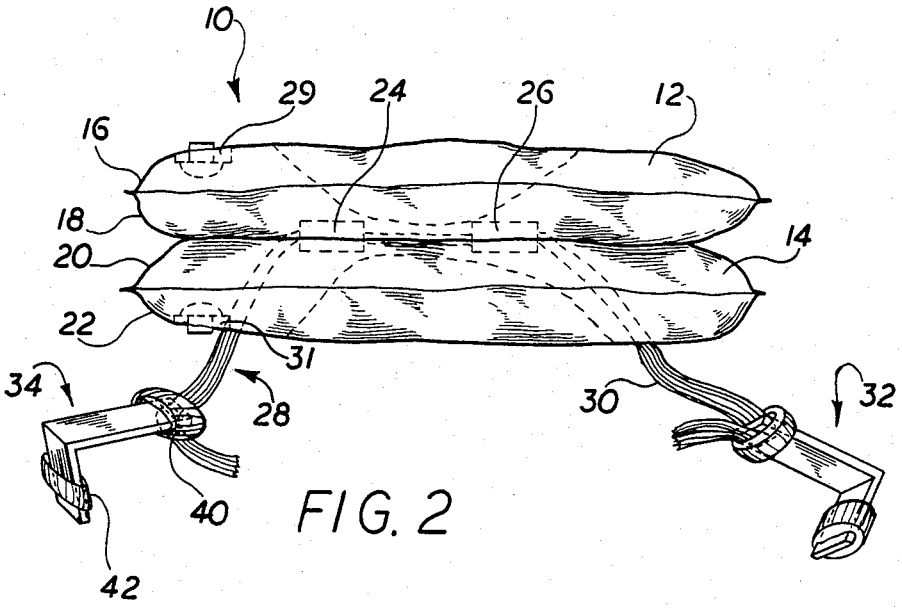
FIG. 2 is an elevational view of the improved shoulder support of the present invention.

With reference to FIGS. 1 and 2, there is shown an improved shoulder support 10 according to the present invention which is adapted for use by the full range of performers on violin or viola. Shoulder support 10 includes a first chamber 12 and a second chamber 14 secured together in facing relation. First chamber 12 may be conveniently formed by securing a pliable and expandable surface 16 to a pliable and expandable surface 18 about their respective peripheries. Likewise, second chamber 14 may be conveniently formed by securing a pliable and expandable surface 20 to a pliable and expandable surface 22 about their respective peripheries. In a preferred embodiment of the invention, first chamber 12 and second chamber 14 are secured together in accordion-like fashion by bonding expandable surface 18 to expandable surface 20 at locations spaced from their respective peripheries. By securing chambers 12 and 14 inboard from their peripheries, a full measure of cushioning in the direction normal to chambers 12 and 14 is provided, while at the same time lateral wobble or movement is restricted.

In this manner shoulder support 10 enjoys an increased measure of lateral stability during vigorous play, i.e., stability in the direction of the plane of chambers 12 and 14, when compared to a single-chamber prior art design of comparable cushioning capacity. To accomodate the full range of performers it is preferred that the combined thickness of chambers 12 and 14 when inflated be up to about 2.5 inches. Of course the invention also contemplates a similarly shaped accordion-like device formed as a unitary article, although it is believed that production advantages are realized by forming shoulder support 10 by the joining of two distinct chambers.

Shoulder support 10 also preferably includes a pair of substantially parallel slots 24 and 26 which are spaced apart and extend through shoulder support 10 from expandable surface 16 to expandable surface 22. Preferably the central areas of first chamber 12 and second chamber 14 adjacent slots 24 and 26 are uninflatable, forming an uninflated region in the central portion of shoulder support 10, surrounded by inflated regions therearound. This design characteristic further enhances the lateral stability of shoulder support 10 during vigorous play. An attachment member 28 is conveniently threaded through each of slots 24 and 26.

Figure 3:
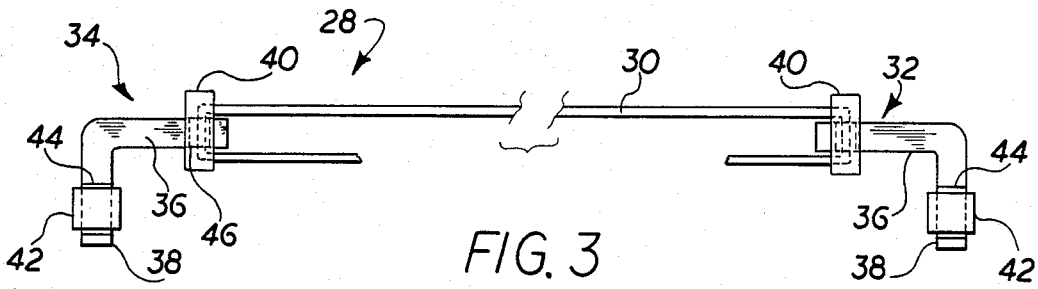
FIG. 3 is an elevational view of the improved resilient attachment strap of the present invention including novel adjusting means therefor.
Figure 4:
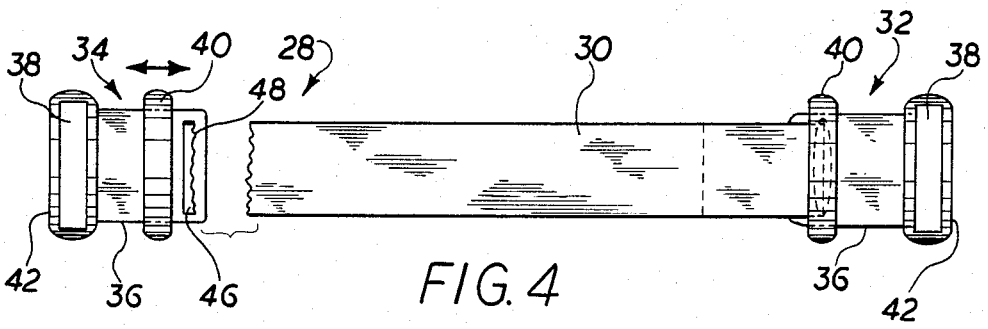
FIG. 4 is a plan view of the resilient attachment strap shown in FIG. 3.

With reference now also to FIGS. 3 and 4, attachment member 28 includes an elongated strap 30 formed of a resilient or stretchable material such as elastic. Strap 30 is threaded through slots 24 and 26, and angular engagement members 32 and 34 are affixed to the ends thereof in a manner to be described. Angular engagement member 32 and 34 each includes a portion 36 which in use extends generally in the direction of strap 30, and a portion 38 which extends from portion 36 at a substantial angle thereto, e.g., 90°. Slidably secured over portion 36 is a resilient pad member 40 and slidably secured over portion 38 is a resilient pad member 42. Portion 38 includes an indented area 44 in which pad member 42 conveniently rests.

Portion 36 further includes a narrow slot 46 having a set of teeth 48 facing toward portion 38. According to the present invention, the effective length of strap 30 is conveniently adjustable through the novel cooperation between pad member 40, strap 30 and slot 46. As best shown in FIGS. 3 and 4, strap 30 may be adjusted to have any desired effective length by threading the end thereof through slot 46, turning it back toward its original direction when it is at a desired length, and sliding pad member 40 along portion 36 until it covers slot 46 and retains strap 30 in the established position therein through the pressure exerted on strap 30 along both upper and lower surfaces of portion 36. Although not limiting to the invention, retention of strap 30 in the desired position is also aided by the action of teeth 48 within slot 46.

The cooperation of strap 30, slot 46 and pad member 40 is particularly beneficial in the present invention because rigid metallic buckles commonly used for such purposes would ten to unacceptably mar and damage the finish on beautiful musical instruments, while at the same time causing undesirable vibrations and buzzing sounds. According to the present invention, no rigid objects contact the instrument when the shoulder support is in position, nor are any small rigid objects positioned where they would tend to buzz. Moreover, it will be appreciated that pad member 40 performs two simultaneous and beneficial functions according to the present invention; it permits convenient adjustment of strap 30 while at the same time providing a cushioned bearing surface for the surface of the instrument. Providing a conveniently adjustable strap 30 permits the shoulder support 10 to be readily transferable between instruments of different dimensions, a feature of particular benefit to schools, and similar institutions.

Shoulder support 10 also preferably includes a first air inlet and exhaust valve 29 in first chamber 12 and second air inlet and exhaust valve 31 in second chamber 14.

In this manner, first and second chambers 12 and 14 may be inflated independently and to differing pressures, to suit the personal preferences of the performer. Of course the invention may be practiced with only a single valve member by providing a communication passage between first chamber 12 and second chamber 14, but such an embodiment would not enjoy the full measure of flexibility otherwise available.

Of course the invention is not intended to be limited by the description of preferred embodiments provided above, but rather by the claims which follow.

I claim:

1. A shoulder support for violin or viola comprising:

a first pliable, inflatable chamber having an air inlet and exhaust means and first and second expandable surfaces sealed together about their outer periphery;

means secured to at least one of said expandable surfaces for retaining an attachment strap thereto; and attaching means including a pliable, elongatably resilient attachment strap attached to said retaining means, said attachment strap including at each of its ends an angular engagement member adapted to engage the exterior surface of said violin or viola to secure said shoulder support thereto and retain said engagement by resilient tension of said attachment strap, said angular engagement members including resilient pad members positioned thereon to face and engage said exterior surfaces of said violin or viola and slot means therethrough to slidably receive said attachment strap, wherein at least one of said pad members on each of said engagement members is slidable on said engagement member and positionable thereon to secure said attachment strap within said slot means at an adjustable desired fixed position while presenting a resilient face to engage the exterior surface of said violin or viola when said shoulder support is secured thereto.

2. The shoulder support as set forth in claim 1, wherein said slot means includes teeth members on its outwardly facing surface to grasp said attachment strap.

3. The shoulder support as set forth in claim 1, further comprising:

a second pliable, inflatable chamber having first and second expandable surfaces sealed together about their outer periphery, said second chamber secured to said first chamber in accordion-like manner with an expandable surface of each of said chambers secured together at locations spaced inward from their respective outer peripheries and unsecured adjacent said respective outer peripheries, wherein said accordion-like manner of securement provides stability in the direction of the plane of said chambers to minimize unintended lateral movement of said violin or viola during play.

4. The shoulder support as set forth in claim 3, wherein said first and second expandable surfaces of each of said first and second chambers are secured together adjacent their central portions to provide a central uninflatable region in said first and second chambers substantially surrounded by inflatable regions thereof.

5. The shoulder support as set forth in claim 4, wherein said second chambers includes a second air inlet and exhaust means.

6. The shoulder support as set forth in claim 4, wherein said first and second chambers share an air communication passageway therebetween and are each inflatable through a single air inlet and exhaust means.

7. The shoulder support as set forth in claim 4, wherein said retaining means is secured to said central uninflatable region.

8. The shoulder support as set forth in claim 4, wherein said first and second chambers provide a combined thickness when inflated of up to 2.5 inches.

9. A shoulder support for violin or viola comprising:

a first pliable, inflatable chamber having first and second expandable surfaces sealed together about their outer periphery;

a second pliable, inflatable chamber having first and second expandable surfaces sealed together about their outer periphery, said first and second chambers secured together in accordion-like fashion with an expandable surface of each of said chambers secured together at locations spaced inward from their respective outer peripheries, wherein said accordion-like fashion of securement provides stability in the direction of the plane of said chambers to minimize unintended lateral movement of said violin or viola during play;

air inlet and exhaust means for introducing air into said first and second chambers;

means secured to at least one of said expandable surfaces for retaining an attachment strap thereto; and attachment strap means including engagement members at each end thereof for securing said shoulder support to said violin or viola.

10. The shoulder support as set forth in claim 9, wherein said first sand second expandable surfaces of each of said first and second chambers are secured together adjacent their central portions to provide a central uninflatable region in said first and second chambers substantially surrounded by inflatable regions thereof.

11. The shoulder support as set forth in claim 10, wherein said second chamber includes a second air inlet and exhaust means.

12. The shoulder support as set forth in claim 10, wherein said first and second chambers share an air communication passageway therebetween and are each inflatable through a single air inlet and exhaust means.

13. The shoulder support as set forth in claim 10, wherein said retaining means is secured to said central inflatable region.

14. The shoulder support as set forth in claim 10, wherein said first and second chambers provide a combined thickness when inflated of up to 2.5 inches.

* * * * *